US012404852B2

(12) United States Patent
Murashko et al.

(10) Patent No.: US 12,404,852 B2
(45) Date of Patent: Sep. 2, 2025

(54) MEMBRANE COMPRESSOR

(71) Applicants: Alex Murashko, Webster, NY (US); Josh Adams, Tabernacle, NJ (US)

(72) Inventors: Alex Murashko, Webster, NY (US); Josh Adams, Tabernacle, NJ (US)

(73) Assignees: Alex Murashko, Webster, NY (US); Josh Adams, Tabernacle, NJ (US)

( * ) Notice: Subject to any disclaimer, the term of this patent is extended or adjusted under 35 U.S.C. 154(b) by 0 days.

(21) Appl. No.: 18/573,308

(22) PCT Filed: Jun. 30, 2022

(86) PCT No.: PCT/US2022/035831
§ 371 (c)(1),
(2) Date: Dec. 21, 2023

(87) PCT Pub. No.: WO2023/278777
PCT Pub. Date: Jan. 5, 2023

(65) Prior Publication Data

US 2024/0295215 A1 Sep. 5, 2024

Related U.S. Application Data

(60) Provisional application No. 63/217,259, filed on Jun. 30, 2021, provisional application No. 63/217,687, filed on Jul. 1, 2021, provisional application No. 63/223,868, filed on Jul. 20, 2021.

(51) Int. Cl.

| | |
|---|---|
| ***F04B 45/053*** | (2006.01) |
| ***F04B 45/04*** | (2006.01) |
| ***F04B 53/00*** | (2006.01) |

(52) U.S. Cl.
CPC ..... *F04B 45/0533* (2013.01); *F04B 45/043* (2013.01); *F04B 53/006* (2013.01)

(58) Field of Classification Search
CPC .. F04B 45/0533; F04B 45/043; F04B 53/006; F04B 45/053
See application file for complete search history.

(56) References Cited

U.S. PATENT DOCUMENTS

| | | | | |
|---|---|---|---|---|
| 1,651,964 A * | 12/1927 | Nelson | F04B 45/0533 | 417/388 |
| 2,713,827 A * | 7/1955 | Hoop | F04B 45/0533 | 417/388 |
| 3,446,197 A * | 5/1969 | Mc-Hale | F02B 71/02 | 123/149 H |
| 2002/0074348 A1* | 6/2002 | Heyes | B01F 35/712 | 222/145.6 |

(Continued)

FOREIGN PATENT DOCUMENTS

| | | |
|---|---|---|
| DE | 1926306 U | 11/1965 |
| GB | 1111602 A | 5/1968 |

*Primary Examiner* — Bryan M Lettman
(74) *Attorney, Agent, or Firm* — Condo Roccia Koptiw LLP

(57) ABSTRACT

A ring-shaped diaphragm compressor may be continuous or non-continuous. Bolting is inboard and outboard of the diaphragm (240). The compression chamber (230) may be circular or other arcuate shape. The diaphragm is driven by a reciprocating piston (68) via hydraulic oil. Pistons may be phased. Mid-valves permit simultaneously outputting two or more different pressures during one or several cycles.

21 Claims, 9 Drawing Sheets

(56) References Cited

U.S. PATENT DOCUMENTS

| | | | | |
|---|---|---|---|---|
| 2003/0170126 | A1* | 9/2003 | Kleibrink | F04B 45/0533 417/383 |
| 2018/0135616 | A1 | 5/2018 | Adams et al. | |
| 2021/0148353 | A1 | 5/2021 | Adams et al. | |
| 2021/0148354 | A1* | 5/2021 | Adams | F04B 45/0533 |

* cited by examiner

*Graph of "Piston 1 Displacement" is not visible because it is overlaid by graph of "Pis*

$$x = r \cdot \cos A + \sqrt{l^2 - r^2 \cdot \sin^2 A}$$

MEMBRANE COMPRESSOR

CROSS REFERENCE TO RELATED APPLICATIONS

This application is the National Stage Entry under 35 U.S.C. § 371 of Patent Cooperation Treaty Application No. PCT/US2022/035831, filed Jun. 30, 2022, which claims benefit from U.S. Provisional Application No. 63/217,259, filed Jun. 30, 2021, U.S. Provisional Application No. 63/217,687, filed Jul. 1, 2021, and U.S. Provisional Application No. 63/223,868, filed Jul. 20, 2021, the contents of each of which are hereby incorporated by reference herein in their entireties.

TECHNICAL FIELD

The invention described herein is related to compressors, and more particularly to a membrane-type compressor.

BACKGROUND

Air and gas compressors are employed for thousands of different purposes. For example, an application area pertaining to high purity gases and hazardous gases as well as high pressure gases is growing as gaseous vehicle fueling and maximum production efficiencies in industrial applications demand very high purity and high capacity combined.

US Patent Publication 2018/0135616 describes the structure and function of technology relevant to compressors, including the shape of the head. A diaphragm compressor, also known as a membrane compressor, is sometimes used for gaseous hydrogen, compressed natural gas, or other dry, high purity, and/or high capacity applications. In a membrane compressor, gas is compressed by back-and-forth or up-and-down movement of a flexible membrane. The membrane movement is often driven by a reciprocal movement of a piston that is connected to a crankshaft by a rod. The piston drives a hydraulic oil on an underside of the diaphragm, which drives a gas on the topside of the diaphragm. Conventional diaphragms can be made of metal (especially for high pressure applications), rubber, silicone, or like materials, depending on the characteristics of the particular application.

Membrane compressors may be configured into stages, for example three stages have been employed to compress hydrogen gas to 6,000 psi (41 MPa) for use in a prototype hydrogen and compressed natural gas (CNG) fueling station. Other mechanisms for compressing hydrogen gas, such as high pressure electrolysis or an ionic liquid piston compressor have been employed.

The standard/traditional membrane compressor head design is a circular chamber (when viewed in transverse cross-section). Some existing compressor designs employ an elongated (or oblong) chamber (when viewed in transverse cross-section), which in some aspects is considered to be an improvement over the circular compression chamber.

FIG. (6*a*) shows crankshafts that are electromechanically coupled at 0 degrees phase.

FIG. (6*b*) shows crankshafts that are electromechanically coupled at 180 degrees phase.

Figure 7:
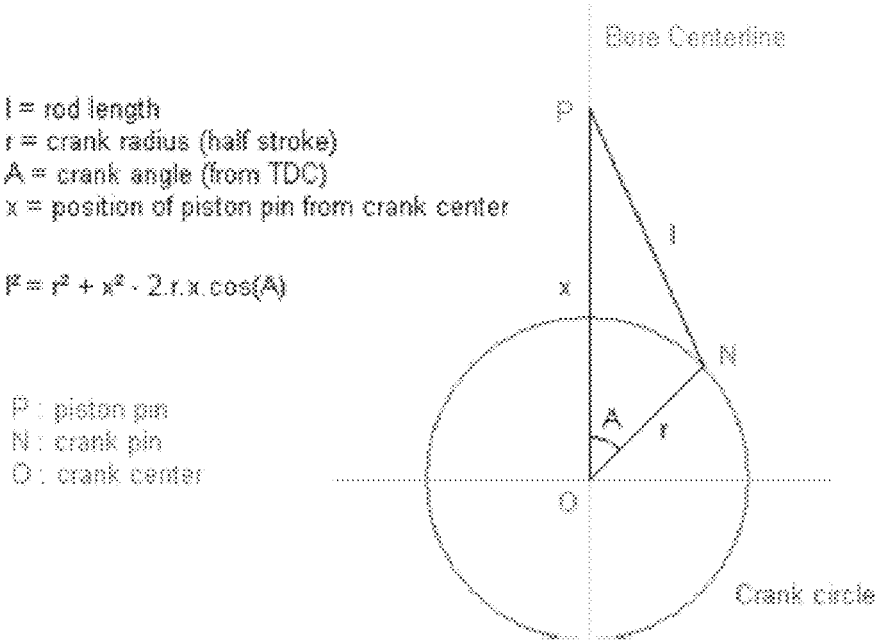

FIG. 7 illustrates the piston motion equation.

SUMMARY

Some of the structures and methods disclosed herein are based on rethinking elongated or oblong membrane compressor technology that conceptually viewed a compression chamber to have a beginning and an end. Accordingly, state of the art (conventional) membrane compressors do not optimize the ratio of structural material volume to compression chamber volume as the design is scaled-up to larger sizes. In this regard, end sections of the cavity may limit the chamber volume due to complex stresses induced in the membrane material.

However, the inventors surmise that if the cavity and compression chamber could be configured or viewed as a continuous volume or nearly continuous volume such that the effects of the ends of the cavity can be eliminated or diminished in importance, the material to compression chamber volume and other parameters can be improved, compared with conventional circular compression chambers and elongated compression chambers. The improvements may have application for dry, high purity, and/or hazardous gas compression.

In some configurations disclosed herein, the stiffening qualities, improved stress distribution, thermal stress improvement or optimization, improved heat transfer for efficiency and reliability, and improved dynamics for increased speed operation of the membrane are stated. In embodiments having a compression chamber employing a center bolt or series of bolts that stiffen the assembly by clamping the heads together (such as at the inner circumference of an ring-shaped compression chamber), improvements are often enhanced. The ring-shaped chamber configuration, in the continuous and non-continuous configurations disclosed herein, may further enhance these aspects.

In this regard, the inventors surmise that a (continuous or non-continuous) ring-shaped compression chamber enables significant scale-up while the compression chamber volume to material volume ratio, Vc/Vm, is substantially increased. Also, the clamping of the upper and lower heads can now be accomplished by bolts at the outer periphery and a large center bolt or series of bolts holding the inner circumference clamped. The decreased dimension between clamped surfaces—that is, a shorter compression cavity ligament span (or beam length)—enables the head material thickness to be reduced, compared with a traditional disc shaped (that is, circular or round) gas (compression) cavity.

Thus, an aspect of increasing capacity of diaphragm compressors is to improve or maximize compression chamber to material volume—that is, material area and/or thickness. A second aspect of increasing capacity is enabling scaling of chamber volume, such as from the range of 150 cc to 500 cc chamber volume to 1000 cc or 15000 cc and larger chamber volume potentially up to 250000 cc while maintaining lifetime and efficiency cost effectively.

Accordingly, a compressor or pump includes a ring-shaped compression chamber, a valve allowing gas into the compression chamber, a valve allowing gas out of the compression chamber, and a driving system for working fluid, such as hydraulic oil or like medium. The ring-shaped compression chamber may be continuous or non-continuous. Preferably, the compressor is of the type referred to in the relevant industry as a membrane compressor or membrane pump. This specification uses the terms "membrane compressor" and "membrane pump" interchangeably, as a person familiar with the relevant technology will understand.

Where circular or an segment of a circle, the compression chamber may have a shape or geometry defined by a thin cross-section revolved around an axis to form a ring (such as, or similar to, a toroid). The term "circular" is used herein to refer to a circle or a segment of a circle.

Where this circular ring is discontinuous, the ring may define an angle of at least 180 degrees, preferably at least 270 degrees, and preferably at least 324 degrees. A continuous, circular ring defines 360 degrees of a circle. If the ring is not circular, the compression chamber defines at least 50%, or at least 75%, or at least 90 percent of a geometric shape most closely matching that defined by the compression chamber. Examples of non-circular rings include an ellipse, an oval, arcuate of shapes, or a variation thereof. Thus, the present invention encompasses continuous and non-continuous compression chamber that are ring-shaped of many varieties.

The cross section (taken through a vertical, radial plane through an axial centerline of the compression chamber) of a circle forms a toroid for a circular revolution about a single center axis. For this embodiment, the ring has an inner perimeter and an outer perimeters that are circular and concentric. Cross sections of other geometric shapes, such an ellipse, oval, and/or other arcuate shapes, are contemplated.

The cross sectional shape may be non-uniform about the ring, as the cross sectional shape may vary with the angular position about the ring. The inner and outer perimeters of the ring may also be non-circular and/or non-concentric.

The compressor may include controls, such as a logic controller having the capacity to learn and maintain and optimized or ideal volume of working fluid. The logic controller may react to transient conditions or any instability or deviation from stable operation that should occur by adjusting the working fluid volume. In this regard, the diaphragm may be configured to not fully displace during compression as controlled by a logic controller. In some circumstances, the diaphragm may not fully displace during suction as controlled by a logic controller. Sensors, such as proximity sensors may be used to determine the position of the membrane.

The compressor system may include a cooling system, such as in a closed loop, for cooling and then reintroducing the working fluid into the system at a lower temperature, and/or the working fluid may cooled within the (working) fluid head, such as by a heat exchanger.

The compression chamber may be configured to include a discharge port at the deepest point or section of the compression chamber cavity. The depth being measured principally perpendicular or vertical to the membrane (when at rest). The term "head" is employed to refer to the shell forming the compression chamber and membrane that defines a gas head and a fluid head (that is, the portions of the head above and below—or on the drive side), respectively, of the membrane. The head contemplated may include more than one compression chamber, as will be understood by persons familiar with conventional gas compressor technology. The compressor head or any compressor seals may be cooled by refrigerated media from a dedicated cooling system or a shared cooling system with adjacent or complimentary equipment.

The compressor inlet valve controls and/or allows gas into the compression chamber. The compressor outlet valve controls and/or allows gas out of the compression chamber. More than one inlet valve and/or more than one outlet valve may be employed, as required by parameters of the design.

The compressor system can include a control system and/or instrumentation (such as temperature sensors, pressure sensors, flow meters, valve actuator position sensors and/or motor feedback signals) adapted for the compressor and/or pump.

A control system may be adapted for receiving information (such as signals from instrumentation) relating to the operations and/or status of the compressor and/or pump and implementing operation of the compressor or pump, including determining or operating to setpoints for pressure, temperature, flow rate, actuating valves, emergency stops. The driving system may include a drive piston connected to a cam, and such that the drive piston sequences the control of flow of gas through the compression chamber cavity. In the preferred embodiment, the driving system works directly on the working fluid or directly upon the membrane.

The method or operating the membrane compressor for compressing gas includes the steps of: providing a gaseous fluid to a gas head of a ring-shaped compression chamber that includes a membrane: and actuating a drive system to act on a working fluid in a fluid head of the ring-shaped compression chamber such that the working fluid actuates the membrane. Actuating the drive system may include driving the piston to sequence and control the flow of the gaseous fluid through the compression chamber via inlet and outlet valves. In this regard, the control system may include learning and/or maintaining an optimized volume of the working fluid to react to transient conditions or instability or deviation from stable operation that should occur by adjusting the working fluid volume. The working fluid may be cooled in an external, closed loop system or internally within the drive system.

In operation, the membrane compressor described herein may output a gaseous fluid, such as hydrogen, over 25 bar. Where hydrogen is the gaseous fluid, it may be output substantially free of oil, water, and other liquids, as persons familiar with gas compression technology understand in view of other compressor types.

For improving efficiency of a diaphragm compressor, the drive piston total displacement volume per cycle (DVPC) may be matched to the compression chamber volume (CCV). Any deviation tends to decrease compressor efficiency. Traditional diaphragm compressors are unable to perfectly match DVPC to CCV. Once a piston and crankshaft design is chosen and built into a compressor, its DVPC typically cannot be changed without disassembling the compressor. Traditionally, this challenge is overcome by adding and removing drive fluid to the hydraulic head each cycle via inlet/outlet valves. This addition and removal of drive fluid decreases efficiency and causes high wear on the associated valving.

An aspect of the present invention uses a logic controller along with variable crankshaft phasing (VCP) to precisely control and change the DVPC. This enables the logic controller to determine the ideal and/or most efficient DVPC for the associated CCV. Further, the logic controller will continually monitor and tune this ratio for optimum performance as parts wear or conditions change.

VCP controlled DVPC as employed in a preferred embodiment offers another advantage over traditional diaphragm compressors. VCP allows for a rapid decrease in DVPC, which can reduce the compressor load without changing crankshaft speed. This is useful for protection of equipment during unexpected surges. This is also useful when the compressor is under a low load. Alternatively, VCP allows for a rapid increase in DVPC, which can increase the compressor load without changing crankshaft speed. This is useful for sudden demands of power such as during hydrogen fueling of a vehicle. In this particular case, the rotational energy of the flywheel is quickly turned into work. The present invention is not limited to compressors or methods or controls for operating a compressor having these improvements.

Further, in many cases hydrogen refueling of vehicles, traditional diaphragm compressors usually need to be staged to overcome the diminishing pressure of supply tanks as hydrogen is moved into vehicles. When supply tanks are nearly full, less work is required to pump the hydrogen into vehicles. As tanks become nearly empty, more work is required to pump the hydrogen into vehicles. This challenge is traditionally overcome by staging several diaphragm compressors in series and turning the stages on and off to match demand. VCP controlled DVPC removes the need to stage diaphragm compressors. The logic controller can easily and rapidly decrease DVPC when less output is required. Alternatively, the logic controller can easily and rapidly increase DVPC when more output is required.

The ring-shaped compressor may include drive piston sequencing that allows each piston to sequentially reach and maintain a fully displaced position until all pistons are released either simultaneously or sequentially. The compressor may include oil porting and/or drive piston sequencing controls for moving the gas from inlet to outlet. The oil porting and/or drive piston sequencing preferably works to causes a wave-like movement of the diaphragm to control gas moving from inlet to outlet. This wave may travel continually around the ring following the path of the perimeter to control gas moving from inlet to outlet. The driver may be mechanical, electric, electromagnetic, electromechanical, or hydraulic.

The compressor may include one or several valves (called mid-valves) adapted for allowing gas out of the compression chamber. The mid-valves are placed such that the diaphragm will block and seal outlets to the mid-valves before the diaphragm is fully displaced during a compression cycle. In some cases, the mid-valves are configured to allow gas to exit the compression chamber at a pressure lower than the final outlet pressure. Thus, the compressor may be capable of simultaneously outputting two or more different pressures during one or several cycles.

Furthermore, the compressor may include independent crankshafts that are coupled to each other via hydraulics which allow intentional and controlled crankshaft phasing. In this regard, the pistons act on the same working fluid. The pistons (such as two pistons) may be coupled together through variable crankshaft phasing to variably control the working fluid displacement per cycle. In some cases, it is beneficial to employ drive pistons that are all the same diameter or vary in diameter. The crankshafts may have the same stroke or have different strokes.

The compressor variable crankshaft phasing may be utilized to finely tune working fluid displacement volume per cycle for optimum efficiency, to increase or decrease compressor energy output, to rapidly increase or decrease compressor load, to change compressor output without changing cycle time, and/or to replace the need for compressor staging.

The independent crankshafts may be tied to each other via a stepper motor (or similar electromechanical coupling) to enable or enhance the intentional and controlled crankshaft phasing. The logic controller may engage logic controlled clutches to promote the intentional and controlled crankshaft phasing, as the logic controlled clutches may be utilized to quickly increase or decrease compressor load.

DETAILED DESCRIPTION

Systems and methods for a membrane compressor, also known as a diaphragm compressor, are explained herein. Some aspects of the systems and methods may enhance compression chamber volume and efficiency, such as to increase or maximize effective compression chamber volume relative to compressor head material volume and to maximize compression chamber surface area to volume. In one embodiment, this is accomplished by using a continuous compression chamber, such as a ring-shaped compression chamber.

Figure 1A:
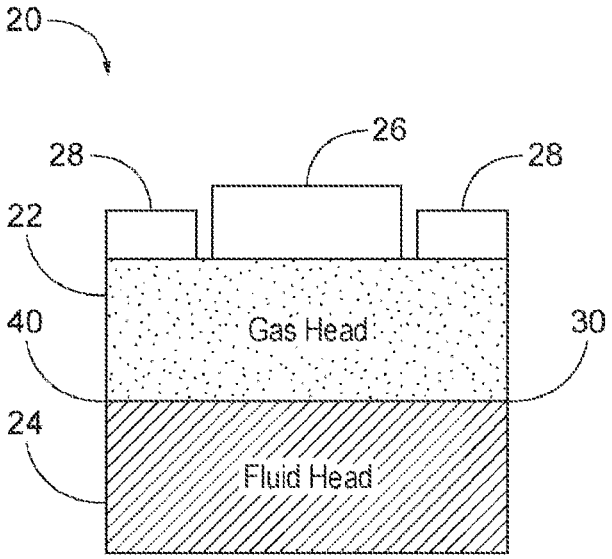
FIG. 1A is a side, schematic view of a head configuration of a membrane ring compressor according to an embodiment of the disclosure.
Figure 1B:
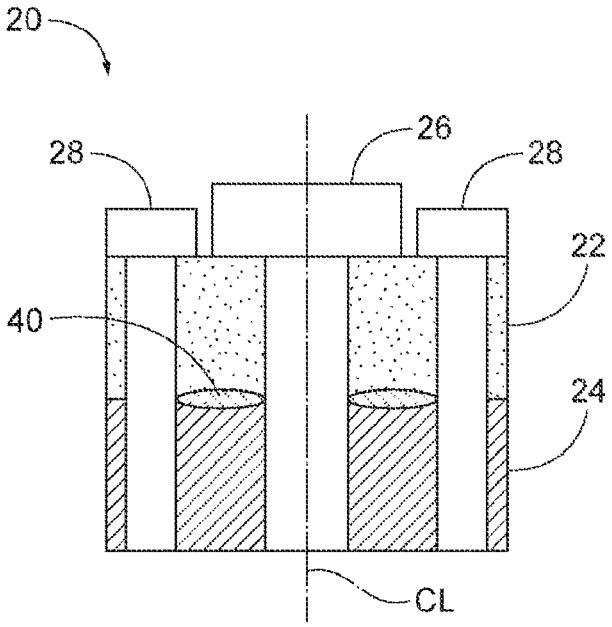
FIG. 1B is longitudinal cross-sectional view of the membrane ring compressor head of FIG. 1A, taken through and parallel to a membrane center axis.
Figure 1C:
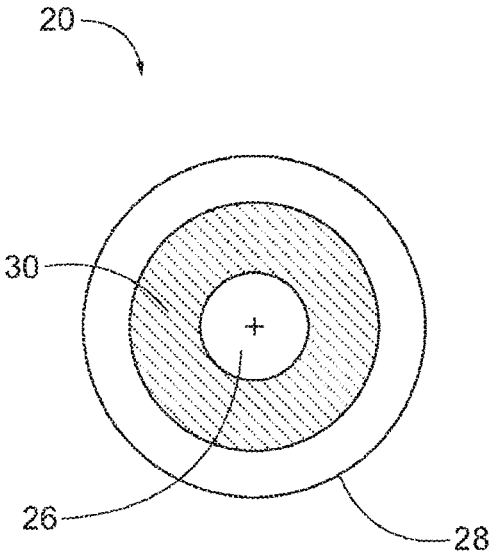
FIG. 1C is a transverse or top cross-sectional view of a first embodiment membrane ring compressor head having a continuous, ring-shaped compression chamber, the cross-section taken in a plane of the membrane or through a transverse midsection of the compression chamber.
Figure 1D:
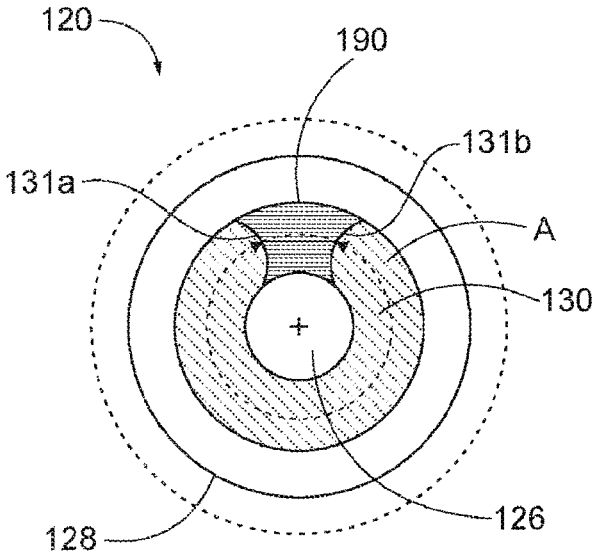
FIG. 1D is a transverse or top cross-sectional view of a second embodiment membrane ring compressor head having a non-continuous, ring-shaped compression chamber, the cross-section taken in a plane of the membrane or through a transverse midsection of the compression chamber.
Figure 1E:
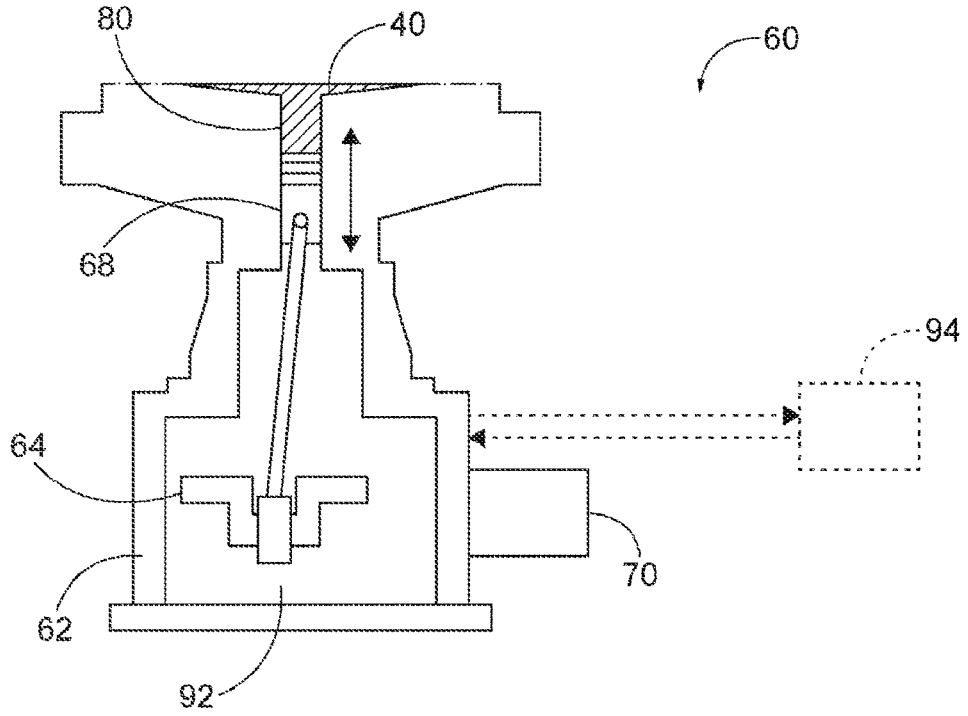
FIG. 1E is schematic illustration of a base assembly for a membrane ring compressor head of FIG. 1A, including a portion shown in black spaced the lobe-shaped ends of the compression chamber apart.
Figure 1F:
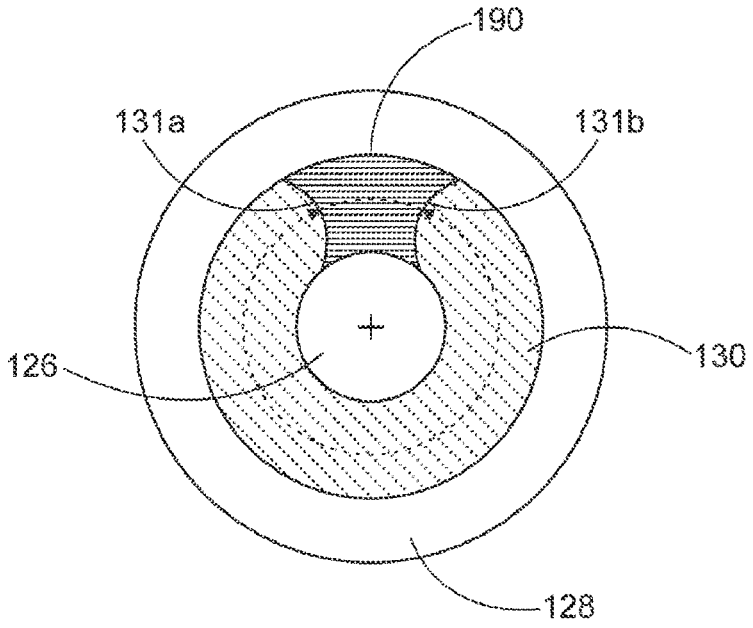
FIG. 1F is an enlarged view of a portion of FIG. 1D, illustrating a schematic view of the non-continuous portion of the ring-shaped compression chamber.
Figure 1G:
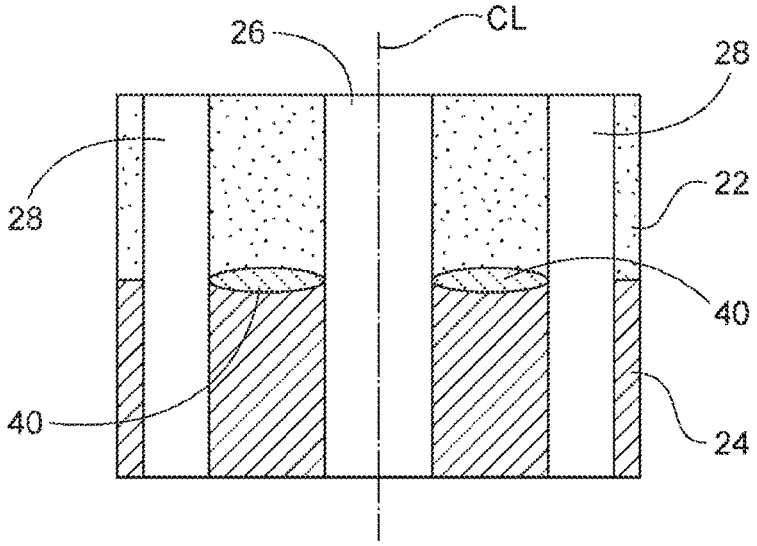
FIG. 1G is an enlarged view of a portion of FIG. 1B, illustrating a schematic view of the compression chamber cross section.

FIGS. 1A through 1G illustrate preferred embodiments and structure of a ring-shaped compression chamber system 10. All of the information in FIGS. 1A-1G is as if set out in text herein. FIG. 1A illustrates a side view of a configuration of a compressor head 20 of a membrane ring compressor 10 including a gas head 22, a fluid head 24, and main bolting. FIG. 1B is a longitudinal cross-sectional view of the membrane ring compressor head 20 illustrating a center or inner bolting 26 and outer bolting 28 that is outboard about the circumference of the compression chamber. FIG. 1G is an enlarged version of a portion of FIG. 1B. The ring-shaped compression chamber 30 is defined by gas head 22 and fluid head 24, which are separated by a membrane 40.

FIG. 1C is a transverse or top cross-sectional view of a first embodiment of the membrane ring compressor head 20. In the continuous ring compression chamber of FIG. 1C, the compression chamber 30, which can be considered to have no beginning and no end, linearly or circumferentially, from the perspective of the gas, and thus is referred to as continuous. In this regard, the gas is not forced against one end of the compression chamber 30 for discharge.

FIG. 1D is a transverse or top cross-sectional view of a second embodiment compressor 110 including a membrane ring compressor head 120. In the non-continuous ring-shaped compression chamber embodiment 130 illustrated in FIG. 1D, the compression chamber 130 preferably extends through an arc A that is most of a circle. For example, the angular or circumferential extent A of the compression chamber in FIG. 1D is less than 360 degrees, preferably at least than 180 degrees, more preferably at least than 270 degrees. A particular embodiment of is 324 degrees. A portion of FIG. 1D is referred to as zero volume & pressure area 190, which is a space between the ends 1321A and 131B of the compression chamber 130, shown as having a lobe-shaped in FIG. 1D. In other words, the zero volume area 190 is a portion within the head 120 that has no cavity/compression chamber, as the lobes of the compression chamber 130 (preferably) are not connected or in fluid communication. The non-continuous ring-shape of FIG. 1D is believed to provide many of the advantages of the continuous ring-shape of FIG. 1C.

The angular extent A of the non-continuous cavity 132 may be measured at a circle that is equidistant between the inner and outer circumference of the cavity (that is, through points equidistant between the radially inner and outer extent of the cavity), as illustrated by the dashed line A in FIG. 1F, which is an enlarged view of FIG. 1D. For embodiments in which the non-continuous compression chamber 130 is not circular (not shown in the figures), the extent of the cavity 130 may be measured by the length of a characteristic cavity line drawn between the inner and outer boundaries of the cavity, ending where the cavity ends. In this regard, the extent of the compression chamber may preferably be at least than 50%, preferably at least 70%, and even more preferably at least 90% of a closed-ended, measured by the length of the characteristic cavity line relative to the corresponding geometry line—that is, the continuous, unbroken line of a geometric shape most closely matching that defined by the compression chamber (in transverse cross section) and coincident with the characteristic cavity line. In the embodiment of FIGS. 1D and 1F, the characteristic cavity line is the portion of the dashed lines A coextensive with the compression chamber, which line is bounded by the arrows of dashed line. The corresponding geometry line A is the characteristic cavity line plus the portion of the circle through the black, filled portion of the image.

The term "ring-shaped" as used herein, encompasses a circle (in transverse cross section and/or top view as oriented in FIG. 4B), but is not limited to perfect geometric circles. Rather, the term "ring-shaped" also encompasses other arcuate geometric shapes, such as an ellipse, oval, or other arcuate or curved shape.

The continuous or non-continuous gas head may be driven by a base assembly or driving system 60 illustrated in FIG. 1E. The base assembly includes a structural frame or housing 62, a crank shaft 64, a rod 66, and a piston 68. The crank shaft 64 is mechanically coupled to a drive 70 (of any conventional type), such as an electric motor and gearbox, belt and pulley system. Rotation of the crank shaft provides and oscillating motion (illustrated by the arrow in Figure, which is oriented and up and down in FIG. 1E) to the piston 68, which transmits force through a hydraulic fluid 80 on the underside of the membrane. A lubrication pump and/or compensation pump 92 may be employed. A hydraulic oil cooling system 94, shown schematically as an external, closed loop cooling system by dashed lines in FIG. 1E, may be employed.

Figure 2A:
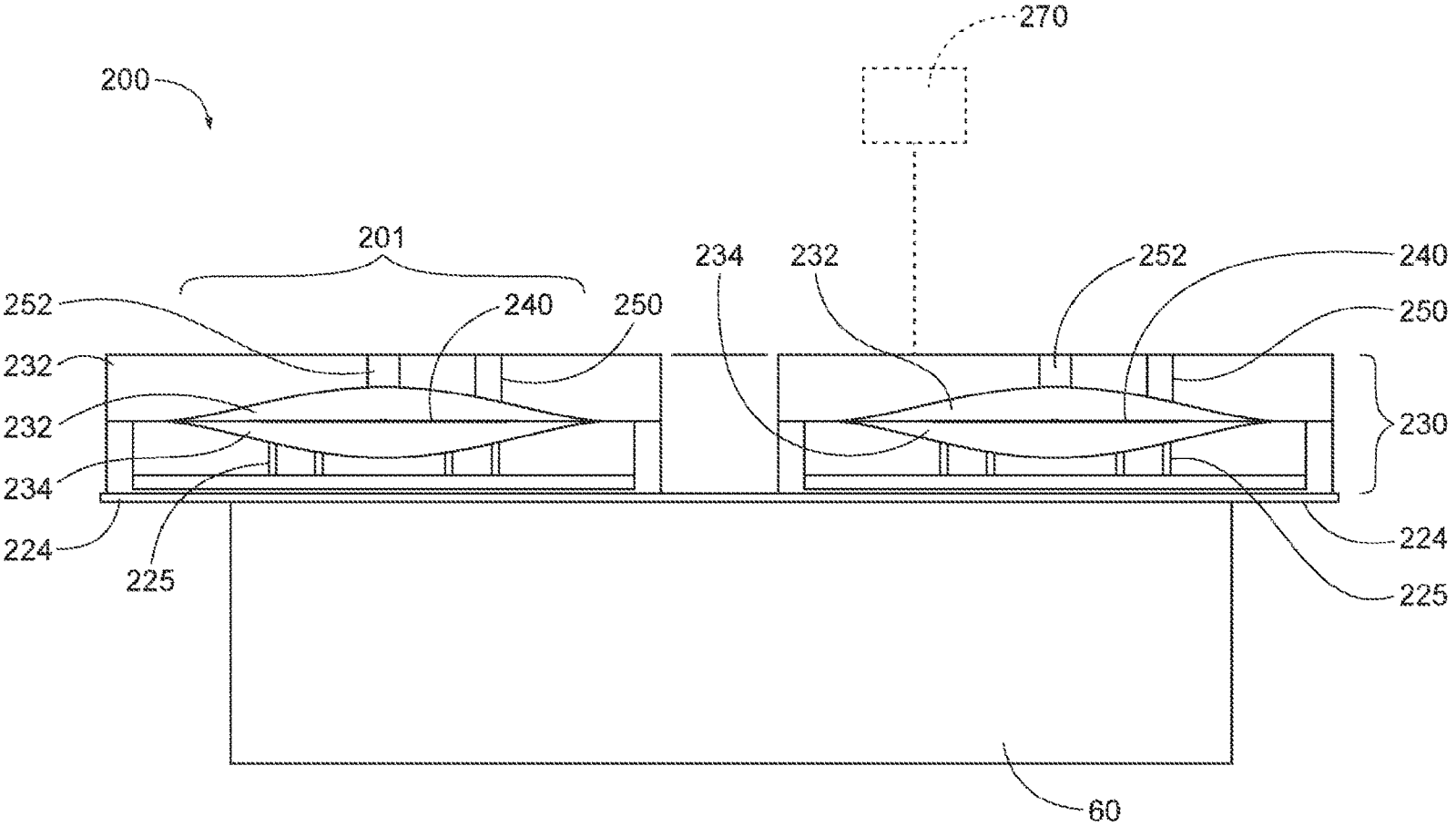
FIG. 2A is a longitudinal cross-sectional view of a conventional compression chamber assembly, including a cavity, a membrane, and a head, taken through a center axis of the circular membrane. The cross sectional shape of the cavity of FIG. 2A is prior art, and the cross section shape may be employed with the cavity of the present invention.

FIG. 2A illustrates a compressor system 210. The longitudinal cross section shape 201 of the cavity 230 in FIG. 2A schematically illustrates a possible cross-sectional shape 201 that may be employed in the embodiments of FIGS. 1C and 1D. The reference CSS 201 identified in FIG. 2A is also identified on FIG. 4B and in the enlarged version in FIG. 1G to illustrate that the cross-sectional shape of the cavity of FIG. 2A may also be employed as the cross section for the embodiments illustrated in FIGS. 1C and 1D. Preferably, the cross-sectional shape is uniform about the circumference. Alternatively, the cross sectional shape of the compression chamber may change about the circular or curved path.

Compression chamber 200 is formed by a head that is divided into a gas head 222 and a fluid head 224 and includes a diaphragm or membrane 240 to form a compression chamber 230. The fluid head 222 includes an annular surface to match the annular shape of the cavity 230 and membrane 240, and to provide a location for a bottom portion of the center bolt or center bolts, shown in FIG. 1A and omitted from FIG. 2A for clarity.

In the embodiment 200 of shown in FIG. 2A, the compression chamber 230 is defined by the upper and lower heads 222, 224 each having forming void or chamber portion 232, 234, respectively, comprising approximately half of the chamber 230, wherein the chamber is divided into an upper chamber and lower chamber by the flexible membrane 240. The upper and chamber and lower chamber are mirror images of each other in the embodiments of the figures. The present invention encompasses other configurations, in which the upper chamber has a cross-sectional shape and/or volume that is different from that of the lower chamber.

The upper head assembly 222 comprises a gas fluid inlet and inlet valve 250 in fluid communication with the gas portion 232 of compression chamber 230. An upstream or inlet side of inlet valve 250 is also in communication with a process fluid connection for connecting the upper compression chamber and a first gaseous system, as will be understood by persons familiar with gas compressor technology. In this way, the gas head 222 receives an input gas. The upper head 222 also comprises an outlet valve 252 in fluid communication with the gas portion 232 of compression chamber 230. A downstream or outlet side of outlet valve 252 is in communication with a process fluid connection downstream of valve 252 for connecting between the upper compression chamber and a second gaseous system, as will be understood by persons familiar with gas compressor technology. In this regard, multiple compressor units described herein may be employed in series or in parallel, as required by design parameters of the facility. Valves 250 and 252 are adapted to sequence the flow of gaseous fluid into and out of compression chamber 230.

The lower head 224 comprises a multitude of ports (as will be understood by persons familiar with membrane compressor technology), including a fluid connection 225 between the lower chamber and the working fluid or system 60. The fluid connection 225 enables the working fluid or system to drive the membrane 240 cyclically between the upper and lower head surfaces to move the process fluid into the head and thereafter out of the head via valves 250 and 252 with an increased pressure and enthalpy. Preferably the pressure ratio between the first gas system (at the head inlet) and second gas system (at the compressor outlet) is at least 1:1.05, or at least 1:1.1, or most preferably at least 1:1.2.

FIG. 2A illustrates a control system 270, which encompasses a logic controller and the instrumentation described herein. It is understood that the instrumentation sensors and communications may be conventional and employed as needed to operate and control the structures and methods described herein.

Figure 4A:
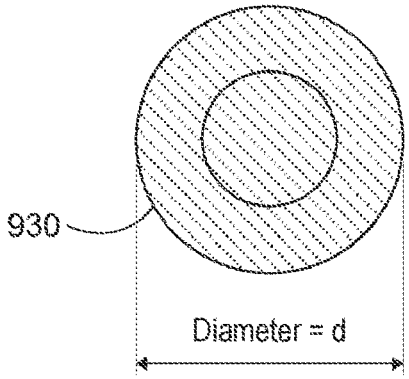
FIG. 4A is a cross-sectional view of the conventional compression chamber of FIG. 3A, taken in the plane of the membrane.
Figure 4B:
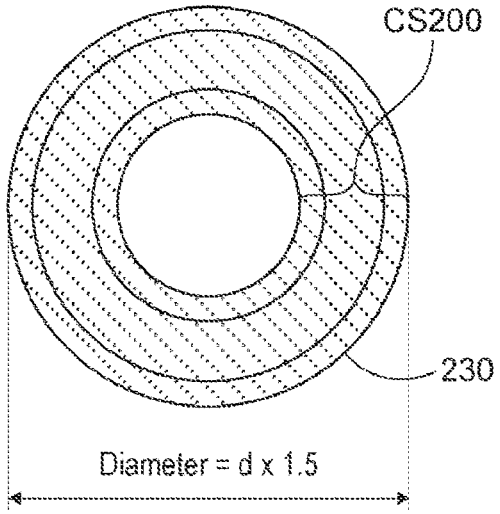
FIG. 4B is a cross-sectional view of the ring-shaped compression chamber of FIG. 3B, drawn to scale, taken in the plane of the membrane, and having approximately the same compression chamber volume of the conventional compression chamber of FIG. 4A.

With reference to a traditional membrane compressor, the prior art chamber 930 is circular (in transverse cross section, such as illustrated schematically in FIG. 4A) and therefore as the diameter of the chamber increases, the pressure load increases with the area being related by the square of the diameter. However, the perimeter has only a linear relationship to the diameter. The inventors had the insight that a point in the sizing of membrane compressors is reached where it becomes difficult to achieve sufficient bolt area to adequately counteract the pressure load while maintaining the stiffness of the structure.

Figure 3A:
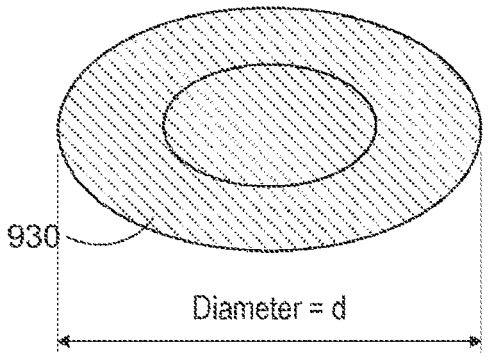
FIG. 3A is an isometric, schematic view of a conventional compression chamber.
Figure 3B:
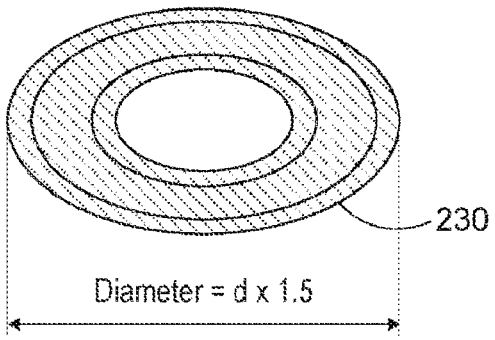
FIG. 3B is an isometric, schematic view of a ring-shaped compression chamber of the type that may be employed with the membrane ring compressor of FIG. 1.

In addition, the center region of the head in a conventional configuration, such as illustrated in FIGS. 3A and 4A, is subject to large bending stresses from the pressure load which need to be overcome by significant increases in head thickness to address head deflection. Also, the design of the traditional compression chamber forces the inlet and outlet valves in close proximity to each other, at or near the center of the head, which can create a complex stress distribution and significant stress risers in some units.

Ideally the inlet and outlet valves are surrounded by cooling such that the temperature is maintained as low as possible and kept uniform, therefore thermal stress in the head is minimized and valve reliability is maximized. In this regard, cooling reduces thermal expansion. Thermal expansion induces stress, potentially concentrated stress. Therefore cooling could be said to benefit most components in the head including the membrane. Cooling is beneficial to the head and valves in structural terms. Plastic valve parts also prefer low temperatures. The conventional compression chamber design poses a further challenge to position the cooling ports due to the close proximity of the valves at the center of the chamber. And as the chamber diameter increases as the compressor is scaled-up, controlling the dynamics of the process and working fluid becomes more challenging.

By having a ring-shaped compression chamber, it is possible to further exploit the materials available for forming the diaphragm by improving or maximizing the Vc/Vm ratio. In the continuous ring-shaped chamber embodiment of FIG. 1C, the chamber is an annulus that has no ends in the plane of the membrane and therefore only 2 sides, an inside and an outside circumferential boundary, thereby eliminating the stress draw backs of the compression chamber ends. In the non-continuous ring-shaped chamber embodiment, the Vc/Vm ratio may be improved and the draw backs of the ends may be diminished.

The inventors believe that a ring-shaped chamber allows improved bolting distribution for clamping, improved cooling for efficiency and reliability, and reduced membrane stress for improved membrane durability. The inventors understood that the ring-shaped design becomes readily and cost effectively scalable to levels previously unattainable. For example, once head material thickness has been specified for a given ring width (outer diameter minus inner diameter), the overall diameter of the compressor can be increased without a change to head material thickness given that same ring width.

Depending on the particular configuration and size of the compression chamber and characteristics of the diaphragm, compression dynamics may accounted for and addressed through porting and channeling, cavity depth, and/or drive piston sequencing, as will be understood by persons familiar with diaphragm compressor engineering and routine testing. For example, the compression chamber cavity may be formed in such a way that the deepest region is at the gas discharge area. In this form, the membrane will reach the deepest portion of the chamber at the end of the stroke and will therefore facilitate gas discharge effectively. Generally it can be stated that gas and hydraulic dynamics within the compression chamber become more challenging as the chamber becomes deeper. Therefore a benefit of the ring design in dynamics can be inferred as the cavity depth will be by nature more shallow: The inventors expect that any other challenges that may arise based upon the length to width ratio of the circumference to cross-sectional relationship of the configuration of FIGS. 1C and 1D may be addressed as explained above.

Referring to FIGS. 5A through 6B, a structure and function for driving the diaphragm may include variable crankshaft phasing (VCP) as a means and method of coupling several (preferably two) crankshafts. For clarity, an example of (2) crankshafts, identified as 64*a* and 64*b*, will be explained. Crankshaft 64*a* drives piston 66*a*, which acts on the drive fluid 80. Crankshaft 64*b* drives piston 68*b* which also acts on the same drive fluid 80. In the embodiment shown, crankshafts 64*a* and 64*b* have the same strokes and pistons 68*a* and 68*b* are the same dimensions. Piston sizes and crankshaft strokes do not have to be the same, and may be chosen according to parameters of membrane compressor design in view of the disclosure herein.

Figure 5A:
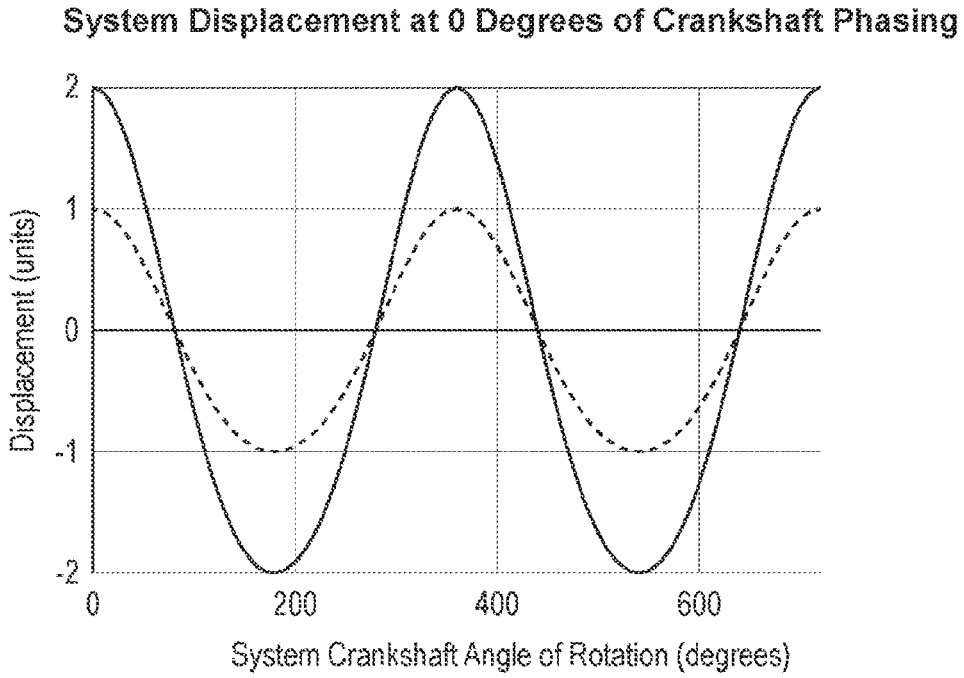
FIG. 5*a* is a diagram of piston displacement at 0 degrees crankshaft phasing.
Figure 5B:
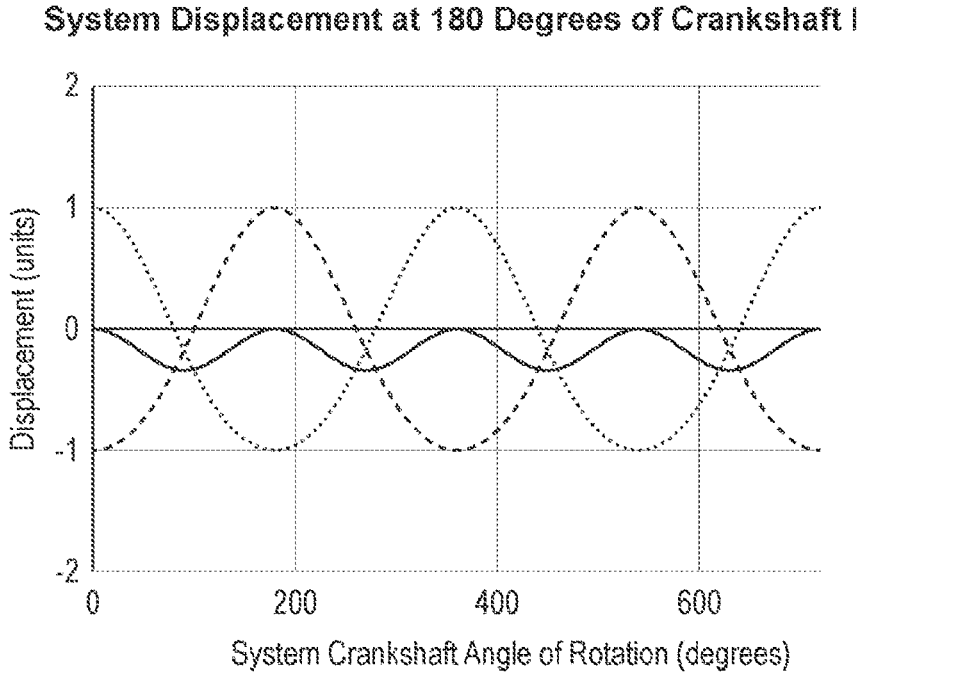
FIG. 5*b* is a diagram of piston displacement at 180 degrees crankshaft phasing.
Figure 5C:
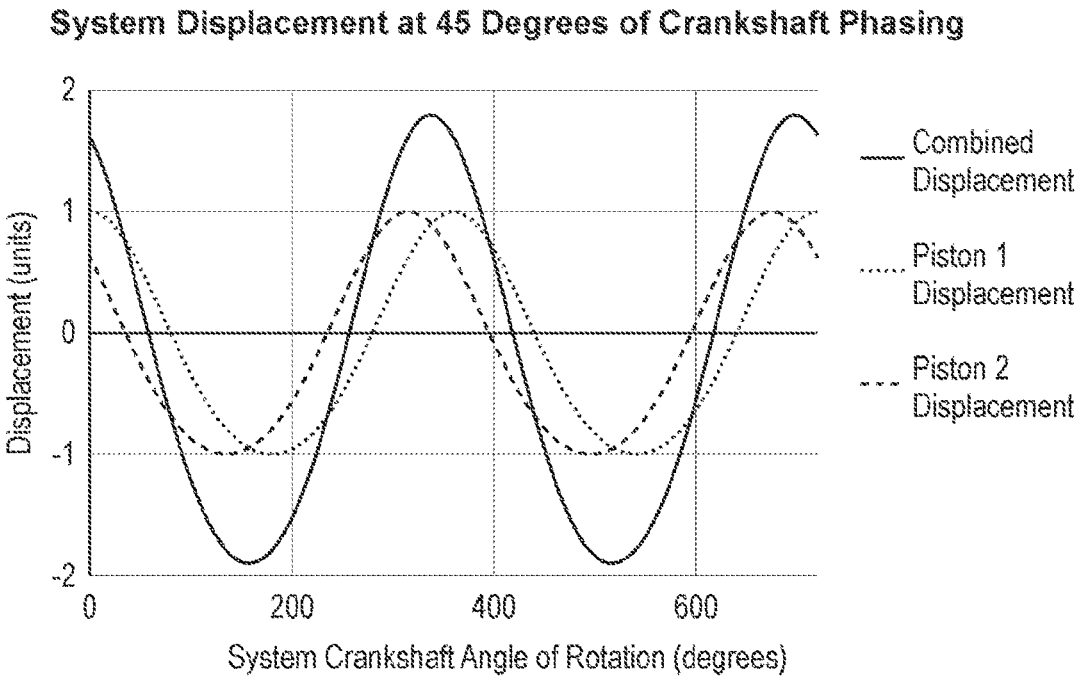
FIG. 5*c* is a diagram of piston displacement at 45 degrees crankshaft phasing.
Figure 6A:
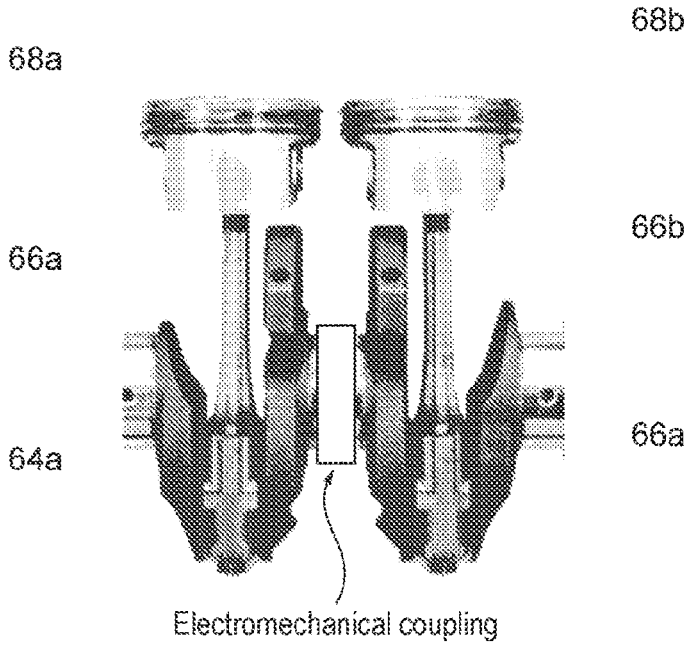
Figure 6B:
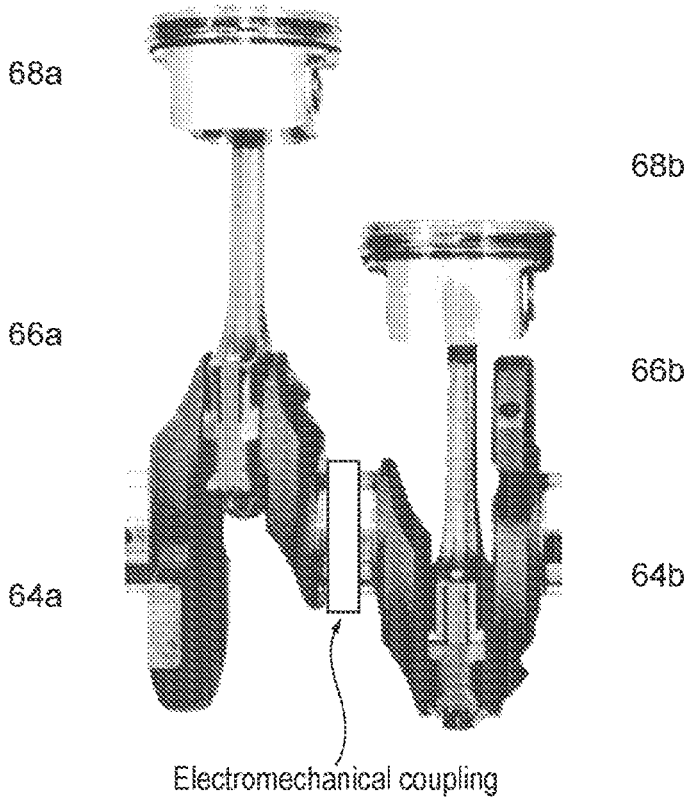

When crankshaft 64*a* and crankshaft 64*b* are coupled at 0 degrees phase, both piston 68*a* and piston 68*b* will move up and down together and the pair will displace a maximum amount of drive fluid. In this example, the volumetric displacement is (4) units per cycle. Each cycle, this displacement will be equal to twice the displacement of one piston if it were acting on its own, as illustrated in FIG. 5A. When crankshafts 64*a* and 64*b* are coupled at 180 degrees phase, piston 68*a* will move in one direction while piston 64*b* moves in the opposite direction. Both pistons will be acting on the same drive fluid and therefore the system total displacement will be much less per cycle than if one piston were acting on its own. In this example, the volumetric displacement is (0.34) units per cycle, less than 1/10 than at 0 degrees phase, as illustrated in FIG. 5B. Using a logic controller, the phase can be set to any desired degree. One last example is crankshaft 64*a* and 64*b* coupled at 45 degrees phase. The volumetric displacement is (3.7) units per cycle, as illustrated in FIG. 5C.

FIG. (6*a*) shows crankshafts that are electromechanically coupled at 0 degrees phase. FIG. (6*b*) shows crankshafts that are electromechanically coupled at 180 degrees phase. The crankshafts may be hydraulically connects, connect to one or more stepper motors or like electric drive, and/or engaged with logic-controlled clutches to achieve sequencing of the piston.

FIG. 7, which is taken from: https://en.wikipedia.org/wiki/Piston motion equations, represents the piston motion equation.

The structure and function disclosed herein has application (for merely one example) for handling hydrogen fuel of the type that can be employed for powering fuel cells, as this type of fuel is generally oil-free and moisture-free. The present invention is not intended to be limited to such hydrogen fuel or the requirements of oil-free and/or moisture-free gases unless specifically stated.

This disclosure provides examples of the structure and function of the compressor or pump. The description of the compressor or pump is not intended to limit the scope of the invention in any way. For example, the scope of the invention is not limited to (or by) the embodiments of the compressor and its function described or shown herein. The invention is not limited in any way by the statements relating to advantages or improvements relative to conventional systems and/or methods, nor is the invention limited by statements of the drawbacks or limitations of the conventional systems and/or methods, as these statements are merely intended to round out the disclosure. No statements relating to conventional technology is intended to be a criticism of the prior art; no information herein relating to conventional system or method should be used as a disclaimer or a justification to narrow the meaning of the terms or phrases herein. Some statements relating to the conventional technology reflect identification of sources or problems in the prior art that may be used as part of the inventive concepts disclosed herein. Further, the phrases "such as" and "for example," and the like, are provided without limitation.

Moreover, the term "membrane compressor" should be given its broadest feasible interpretation, and should also be understood to include "diaphragm compressor," as the terms "membrane" and "diaphragm" are used interchangeably herein. It is understood that the terms "compressor" and "pump" are intended to refer to the rotational equipment component itself and to a system in which the component is part. Further, ranges are may be provided herein without reciting an upper limit, as the upper limits are practical limits that will be understood by persons familiar with the technology.

The invention claimed is:

1. A membrane compressor comprising:

a ring-shaped compression chamber, an inlet having an inlet valve adapted for allowing a gaseous fluid into the compression chamber, an outlet having an outlet valve adapted for allowing the gaseous fluid out of the compression chamber, a driving system adapted for acting on a working fluid to act on a membrane, and the membrane separating the compression chamber into a gas head in communication with the inlet valve and the outlet vale and a fluid head in communication with the driving system.

2. The compressor of claim 1 wherein the ring-shaped compression chamber is continuous.

3. The compressor of claim 1 wherein the ring-shaped compression chamber is circular and non-continuous such that the compression chamber defines an angle of at least 180 degrees.

4. The compressor of claim 1 wherein the ring-shaped compression chamber is non-circular and defines at least 50% of a geometric shape most closely matching the shape defined by the compression chamber.

5. The compressor of claim 1 wherein a compression chamber geometry is defined by a thin cross-section revolved around an axis to form a ring, the cross-section being constant about the revolution or varying about the revolution to form a circular or a non-circular ring, the ring being one of a circle, an ellipse, an arcuate geometry, and/or a combination thereof.

6. The compressor of claim 1 wherein the driving system includes a drive piston adapted for sequencing with an other piston of the driving system and/or an other piston of an adjacent compressor for controlling flow of the gas through the compression chamber.

7. The compressor of claim 6 wherein crankshafts of the drive pistons are mechanically independent and coupled to each other via hydraulics which allow intentional and controlled crankshaft phasing.

8. The compressor of claim 1 further comprising a logic controller adapted for learning and/or maintaining an optimized volume of the working fluid such that the logic controller is adapted to react to transient conditions or instability or deviation from stable operation that should occur by adjusting the working fluid volume.

9. The compressor of claim 1 further comprising a logic controller adapted for learning and/or maintaining an optimized volume of the working fluid such that the logic controller is adapted to react to transient conditions or instability or deviation from stable operation.

10. The compressor of claim 9 wherein the logic controller is further adapted to control oil porting and/or drive piston sequencing controls for moving gas from the inlet to the outlet via a wave-like movement of the membrane to control gas moving from the inlet to the outlet.

11. The compressor of claim 10 further comprising instrumentation including at least one of temperature sensors, pressure sensors, flow meters, valve actuator position sensors and/or motor feedback signals, and further comprising a control system adapted for receiving information from the instrumentation relating to the operations and/or status of the compressor and/or pump and implementing operation of the compressor, including determining or operating to setpoints for pressure, temperature, flow rate, actuating valves, and/or emergency stops.

12. The compressor of claim 1 wherein the gaseous fluid is hydrogen that is substantially free of oil, water, and liquids.

13. The compressor of claim 1 further comprising one or more mid-valves adapted for enabling an exit of gas out of the compression chamber at a pressure lower than a maximum outlet pressure.

14. The compressor of claim 13 wherein the one or more mid-valves are located relative to the gas head such that the membrane is adapted for blocking and sealing outlets to the mid-valves before the membrane is fully displaced during a compression cycle, the one or more mid-valves being adapted for simultaneously outputting two or more different pressures during one or several cycles of the compressor.

15. A method for compressing gas in a membrane compressor, comprising the steps of:

providing a gaseous fluid to a gas head of a ring-shaped compression chamber that includes a membrane; and actuating a drive system to act on a working fluid in a fluid head of the ring-shaped compression chamber such that the working fluid actuates the membrane separating the fluid head from the gas head in the ring-shaped compression chamber.

16. The compressor of claim 15 wherein the drive system includes at least two pistons, each piston being mechanically independent of the other of the at least two pistons, such that the step of actuating the drive system includes sequencing phases of the at least two pistons to sequence and control flow of the gaseous fluid through the compression chamber.

17. The method of claim 16 wherein the piston sequencing step enables each one of the at least two pistons to sequentially reach and maintain a fully displaced position until all pistons are released either simultaneously or sequentially.

18. The method of claim 16 wherein the step of actuating the drive system includes learning and/or maintaining an optimized volume of the working fluid and reacting to transient conditions or instability or deviation from stable operation that should occur by adjusting the working fluid volume.

19. The method of claim 16 wherein the step of sequencing the sequencing of the phases includes variable crankshaft phasing, such that the variable crankshaft phasing is utilized to at least one of:

finely tune working fluid displacement volume per cycle for optimum efficiency; increase or decrease compressor energy output; rapidly increase or decrease compressor load; and change compressor output without changing cycle time.

20. The method of claim 15 wherein the drive system includes at least two pistons, each piston having a crankshaft that is mechanically independent of an other crankshaft of the least two pistons, each crankshaft being controlled by one or more stepper motors and/or logic-controlled clutches such that the step of actuating the drive system includes sequencing phases of the at least two pistons to sequence and control flow of the gaseous fluid through the compression chamber.

21. The method of claim 15 further comprising the step of simultaneously outputting two or more different pressures during one or several cycles of the compressor via the membrane blocking and sealing outlets to mid-valves.

* * * * *